US007124019B2

(12) United States Patent
Goodell et al.

(10) Patent No.: US 7,124,019 B2
(45) Date of Patent: Oct. 17, 2006

(54) POWERTRAIN CONTROL MODULE SPARK DURATION DIAGNOSTIC SYSTEM

(75) Inventors: Kirk R. Goodell, Dearborn, MI (US); James D. McCoy, Flat Rock, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/913,560

(22) Filed: Aug. 6, 2004

(65) Prior Publication Data

US 2006/0030993 A1 Feb. 9, 2006

(51) Int. Cl.
*F02P 17/12* (2006.01)

(52) U.S. Cl. ..... 701/114; 324/388; 324/399

(58) Field of Classification Search ..... 701/114; 324/380, 388, 399

See application file for complete search history.

(56) References Cited

U.S. PATENT DOCUMENTS

| | | | | |
|---|---|---|---|---|
| 4,366,794 | A | 1/1983 | Hachiga et al. | |
| 4,690,124 | A * | 9/1987 | Higashiyama | 123/643 |
| 4,918,389 | A | 4/1990 | Schleupen et al. | |
| 5,014,676 | A | 5/1991 | Boyer | |
| 5,046,470 | A | 9/1991 | Entenmann et al. | |
| 5,283,527 | A | 2/1994 | DeBiasi | |
| 5,327,090 | A | 7/1994 | Shimasaki et al. | |
| 5,334,938 | A | 8/1994 | Kugler et al. | |
| 5,411,006 | A | 5/1995 | Noble et al. | |
| 5,801,534 | A | 9/1998 | Hohner et al. | |
| 6,216,678 | B1 | 4/2001 | James et al. | |
| 6,236,213 | B1 * | 5/2001 | Maruta et al. | 324/399 |
| 6,415,656 | B1 | 7/2002 | Bidner et al. | |
| 6,426,626 | B1 * | 7/2002 | Kravis | 324/388 |
| 6,559,647 | B1 | 5/2003 | Bidner et al. | |
| 2003/0121509 | A1 | 7/2003 | Schmied | |

OTHER PUBLICATIONS

G..B. Search Report dated Oct. 20, 2005 for GB 0515250.9.

* cited by examiner

*Primary Examiner*—Andrew M. Dolinar
(74) *Attorney, Agent, or Firm*—Diana D. Brehob; Richard M. Sharkansky

(57) ABSTRACT

A system and method for diagnosing ignition system performance of an internal combustion engine. The method operates an engine control unit to produce a sequence of spark ignition current pulses through primary windings of a plurality of ignition coils. The current pulses produce voltage pulses across electrodes of the spark plugs. The voltage pulses produce flyback voltages across the primary windings. Output pulses are produced in response to the flyback voltages having time durations related to the time durations of the sparks produced by the spark plugs. Digital signal are produced in response to each one of the output pulses representative of the spark time duration of a corresponding one of the sparks. A comparison of the digital signals determines whether the spark time duration of one of the spark plugs is substantially different from the spark time durations of the other ones of the plurality of spark plugs.

4 Claims, 13 Drawing Sheets

POWERTRAIN CONTROL MODULE SPARK DURATION DIAGNOSTIC SYSTEM

TECHNICAL FIELD

This invention relates generally to internal combustion engine ignition diagnostic systems.

BACKGROUND

As is known in the art, present on-board diagnostic (OBD) systems utilize the coil primary charge current (partial dwell flag current and time), as the indication for a "good" ignition event. Ignition Primary Circuit failures are identified by a corresponding DTC (Diagnostic Trouble Code). At the present time, the technician does not have the ability to determine any type of ignition system secondary issues beyond misfire DTC's. Any issues in the ignition system not related to the coil primary charge circuit, such as open coil secondary windings, internal shorted secondary windings, extreme fouling of spark plugs, etc., will not be identified by an ignition DTC. Although it is true that in most cases a misfire DTC will be generated due to secondary faults, this leaves the technician with multiple possibilities as to the root cause of the misfire, (i.e. Powertrain Control Module (PCM), fuel system, unmetered air, valves, etc.), which can result in misdiagnosis and increased warranty costs.

SUMMARY

In accordance with the present invention, a system is provided for diagnosing ignition system performance of an internal combustion engine. The system includes a spark plug and an ignition coil having a secondary winding coupled to the spark plug and a primary winding. An engine control unit is provided for producing a controlled current pulse through the ignition coil primary winding. By switching the primary from on to off, a high voltage surge or pulse is induced in the secondary winding of the ignition coil and across the electrodes of the spark plug. This high voltage surge is also reflected back into the coil primary winding in the form of back EMF or flyback voltage. The engine control unit produces, in response to the flyback voltage, a digital signal representative of the time duration of the spark.

In accordance with another feature of the invention, a system is provided for diagnosing ignition system performance of an internal combustion engine. The system includes an engine having a plurality of spark plugs and a plurality of ignition coils, each one having a secondary winding coupled to a corresponding one of the plurality of spark plugs, each one of the plurality of ignition coils having a primary winding. An engine control unit is provided for producing a sequence of spark ignition current pulses through the primary winding of the plurality of ignition coils. The primary current pulses produce a secondary high voltage surge across electrodes of the spark plugs. The secondary high voltage surge produce sparks across the electrodes of the spark plugs and flyback voltages across the primary windings. The engine control unit produces, in response to the flyback voltages, digital signals representative of the time durations of the sparks.

In accordance with another feature of the invention, a method is provided for diagnosing ignition system performance of an internal combustion engine having: a plurality of spark plugs; a plurality of ignition coils, each one having a secondary winding coupled to a corresponding one of the plurality of spark plugs, each one of the plurality of ignition coils having a primary winding; and an engine control unit. The method includes: operating the engine control unit to produce a sequence of spark ignition current pulses through the primary winding of the plurality of ignition coils, such current pulses producing sparking voltage pulses across electrodes of the spark plugs, such sparking voltage pulses producing sparks across the electrodes of the spark plugs and flyback voltages across the primary windings; producing, in response to the flyback voltages, digital signals representative of the time durations of the sparks; and comparing the digital signals to determine whether the spark time duration of one of the spark plugs is substantially different from the spark time durations of the other ones of the plurality of spark plugs.

We have discovered that by monitoring the ignition coil primary winding flyback signals internal to the PCM, it is possible to diagnose multiple secondary issues, as well as primary. By measuring the primary winding flyback signal, spark duration, or burn time, decisions can be made as to the quality of the spark event. For example, a short duration indicates high resistance in the secondary while long durations show a short or foul condition. Onboard spark duration analysis provides a non-intrusive method of monitoring and analyzing secondary spark duration as well as providing a method to measure inaccessible ignition coil windings which would aid in diagnosing root cause failures as well as reduce warranty costs.

Using the PCM, it is possible to monitor the ignition coil primary winding flyback voltage signal, filter or condition the signal, set threshold levels for the rise and fall of the duration and output a representative pulse width corresponding to the spark duration using a software algorithm. The value of each cylinder's spark duration pulse width is displayed to the technician in a parameter identification (PID) format via the communication link. A "block" of relative duration values, for all cylinders (4,6, 8, etc.), is displayed (2 continuous revolutions displaying 1 complete engine cycle). Data are stored in a PID array within RAM 58 (FIG. 1) and is displayed to the technician for one complete engine cycle. It is understood that due to RPM limitations, not all data can be captured and displayed, however, the data that are displayed to the technician would always be for a complete engine cycle (i.e., 2 revolutions). No determination of "Pass" vs. "Fail" would be made by the engine control unit (these judgments would be made by the technician based on his interpretation of the relative duration readings), nor would any DTC be set based on duration values. Thus, the OBD Spark Duration test may be used in addition to the present misfire DTC's as well as ignition coil primary winding charge current DTC's.

The invention thereby provides a totally non-intrusive means of identifying secondary ignition failures in an inductive ignition system. The method requires no external engine connections by the technician to interrogate all engine cylinder secondary ignition spark events. Measurement of the ignition coil primary winding flyback signal as well as data transfer is done entirely internal to the engine control unit, typically the Powertrain Control Module (PCM). Each cylinder's spark event is compared to the other cylinder's spark event (relative reading) for each complete engine cycle (720°) via a scan tool connected at the data link connector. This allows the technician to investigate the ignition system secondary, regardless of ignition coil accessibility, simply by connecting a scan tool to the vehicle data link connector.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 10 is for a non-fault condition, FIG. 11 is for a fault in one of the cylinders because of secondary arcing, and FIG. 12 is for a fault because of an open condition is indicated in a secondary ignition coil winding.

Like reference symbols in the various drawings indicate like elements.

DETAILED DESCRIPTION

Figure 1:
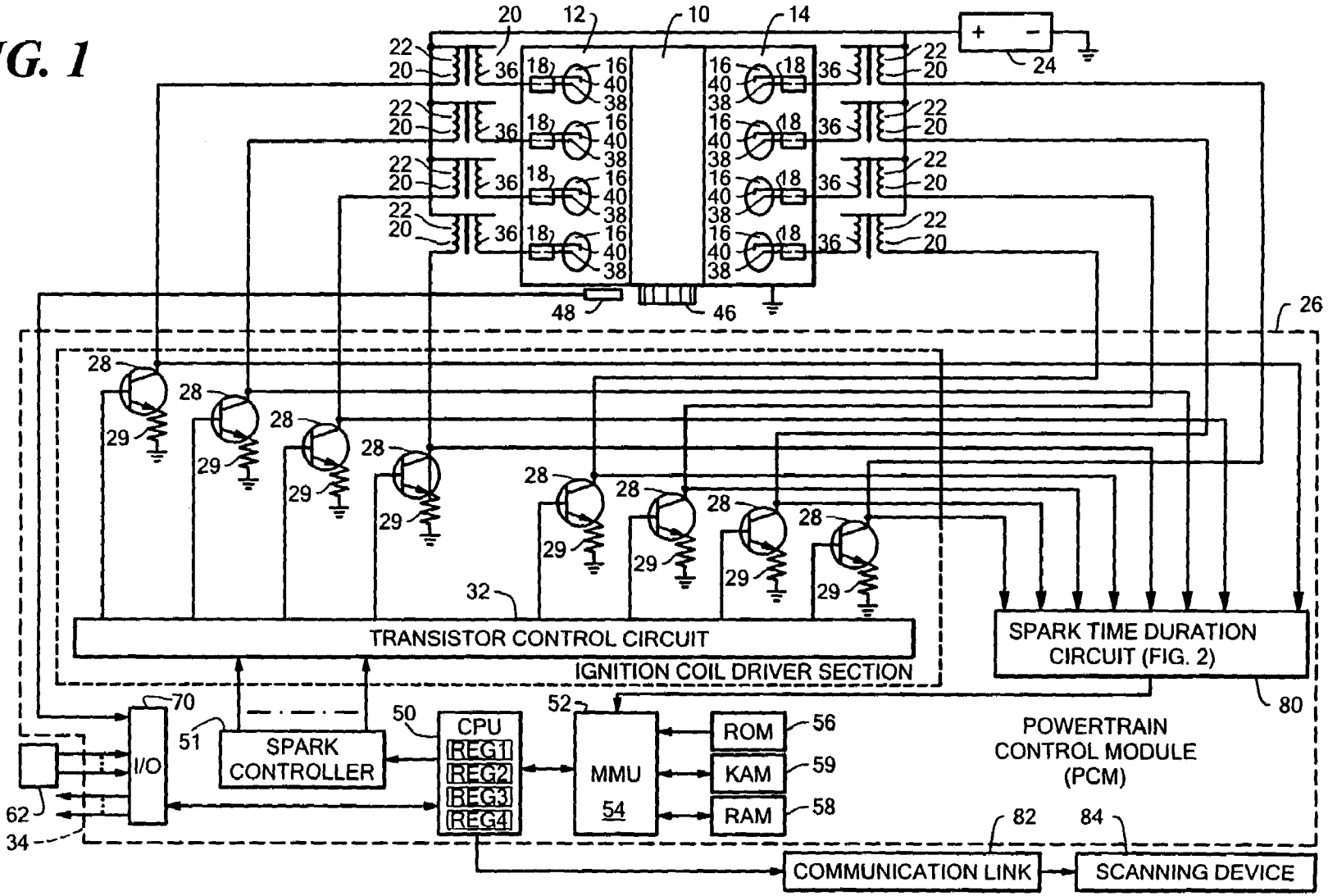
FIG. 1 is a diagram of an engine having a spark plug diagnostic system according to the invention.

Referring now to FIG. 1 a V-8 engine 10 is shown. Engine 10 contains two banks, 12 and 14, of cylinders with four cylinders in each bank. The present invention applies to any number of engine banks with any number of cylinders per bank. Each cylinder 16 contains a spark plug 18. However, the present invention also applies to more than one spark plug per cylinder. The spark plugs 18 are connected to ignition coils (i.e., transformers) 20, as shown.

Each one of the transformers 20 has a low voltage primary winding 22 connected between the positive terminal (+) of a battery 24, here a 12 volt battery, and an ignition coil driver circuit section 26. More particularly, considering an exemplary one of the transformers (i.e., ignition coils) 20, the primary winding 22 thereof has a first end connected to the + terminal of the battery 24 and a second end connected to the collector of a corresponding one of a plurality of, here eight, transistors 28. Here the transistors 28 are IGBTs. The emitter of each one of the transistors 28 is connected to ground through a corresponding one of a plurality of resistor 29, as shown. Each one of the transistors 28 is turned on and off by a control signal fed to the control electrode, here to the base electrode thereof by a transistor control circuit 30. The spark controller 51, in response to the CPU 52, provides the signals to the transitor control circuit 30. The transistors 28 and transistor control circuit 30 are included in an ignition coil driver section 32, as shown. The ignition coil driver section 32 is included in the engine control unit, here the powertrain control module (PCM) 34.

Each one of the transformers 20 has a high voltage secondary winding 36 is inductively coupled to the primary winding 22 of such transformer 20. The secondary winding 36 has a first end connected to the positive terminal (+) of the battery 24 and a second end connected to the non-grounded electrode 38 of a corresponding one of the spark plugs 18. The grounded electrode 40 is in contact to the grounded end engine block 44. The negative electrode (−) of the battery 24 is also grounded to the engine block 44. Ignition coil transformer 20 transforms a low voltage pulse applied to the primary winding 22 to a high voltage pulse on the secondary winding 36, which is provided to across the electrodes 38, 40 of the spark plug 18.

Engine 10 has a toothed disk 46 coupled to the crankshaft (not shown) of engine 10. Sensor 48 provides an output as the teeth of toothed disk 46 pass by sensor 48 to thereby provide an indication of the crankshaft angle. Engine speed can be computed based on the signal from teeth passing sensor 48.

A piston (not shown) is disposed and reciprocates within each cylinder 16 of engine 10. In four-stroke operation, the processes are: an intake stroke during which the piston moves down or away from the cylinder head (not shown) in which the spark plugs 18 are typically disposed, a compression stroke as the piston moves up, an expansion or power stroke as the piston moves down, and an exhaust stroke as the piston moves up. Combustion typically is initiated toward the end of the compression stroke with the majority of combustion occurring during the expansion stroke. If spark plugs 18 fail to ignite the fuel and air mixture in a particular cylinder, the mixture does not combust and the expansion stroke provides much less power to the engine's crankshaft than if a combustion event had occurred. The rotational speed of engine 10 dips slightly when combustion in one of the cylinders fails to occur. The drop in speed, however, is momentary and occur only during part of a revolution of engine 10 because the next cylinder to undergo an expansion stroke produces power causing engine 10 to re-attain the speed prior to misfire.

An engine control unit (ECU) herein referred to as the Powertrain Control Module (PCM) 34 is provided to control engine 10, in general, and spark plugs 18, as shown specifically in FIG. 1. The PCM 34 has a microprocessor 50 which includes a central processing unit (CPU) 52, in communication with memory management unit (MMU) 54. The MMU 54 controls the movement of data among the various computer readable storage media and communicates data to and from CPU 52. The computer readable storage media preferably include volatile and nonvolatile storage in read-only memory (ROM) 56, random-access memory (RAM) 58, and keep-alive memory (KAM) 59, for example. The KAM 59 may be used to store various operating variables while CPU 52 is powered down. The computer-readable storage media may be implemented using any of a number of known memory devices such as PROMs (programmable read-only memory), EPROMs (electrically PROM), EEPROMs (electrically erasable PROM), flash memory, or any other electric, magnetic, optical, semiconductor chip, or combination memory devices capable of storing data, some of which represent executable instructions, used by CPU 52 in controlling the engine or vehicle into which the engine is mounted. The computer-readable storage media may also include floppy disks, CD-ROMs, hard disks, and the like. The CPU 52 communicates with various sensors and actuators via an input/output (I/O) interface 60. Examples of items that are actuated under control by CPU 52, through I/O interface 60, are fuel injection timing, fuel injection rate, fuel injection duration, throttle valve position, spark plug timing, and others. Sensors 62 communicating input through I/O interface 60 may be indicating engine rotational speed, vehicle speed, coolant temperature, manifold pressure, pedal position, throttle valve position, air temperature, exhaust temperature, and air flow.

Some PCM 34 architectures do not contain MMU 54. If no MMU 54 is employed, CPU 52 manages data and connects directly to ROM 56, RAM 58, and KAM 59. Of course, the present invention could utilize more than one CPU 52 to provide engine control and PCM 34 may contain multiple ROM 56, RAM 58, and KAM 59 coupled to MMU 54 or CPU 54 depending upon the particular application.

Spark plug timing is determined in CPU 52 and communicated to ignition coil driver section 30. In an inductive ignition system, the ignition primary winding 22 circuit is switched by means of the ignition coil driver section 32 internal to the PCM 34. The current flow, or dwell, through the primary winding 22 is controlled by the PCM 34 by providing a ground path through the ignition coil driver section 32 to ground. More particularly, when the control signal to the base electrode of a transistor 28 is high the transistor 28 turns "on" and thereby provides a current path from the battery 24 through the primary winding 22, through the collector electrode and emitter electrode to ground. When the transistor 28 is switched "on", current rapidly builds from 0 to a maximum value determined by the winding's inductance and resistance. This current flow induces a magnetic field within the primary winding 22. When the transistor 28 is switched "off" to thereby turn the current "off", the magnetic field collapses which cuts the windings of the secondary winding 36 and induces a secondary high voltage surge or pulse to initiate a spark across the electrodes 38, 40. This surge is also reflected back into the primary winding 22 in the form of back electromagnetic force (EMF) or flyback voltage.

Thus, the microprocessor 50 operates to produce a sequence of spark ignition current pulses through the primary winding 32 of the plurality of ignition coils, 20. The current pulses produce a high voltage surge or pulse across the secondary windings 36 and therefore across the electrodes 38, 40 of the spark plugs 18. The high voltage surge or pulse produces sparks across the electrodes 38, 40 of the spark plugs 18 and flyback voltages across the primary windings 32. As will be described in more detail below, a spark time duration circuit 80 is responsive to the flyback voltages to produce output pulses, SPDUR, having time durations related to the time durations of the sparks produced across the electrodes 38, 40 of the spark plugs 18. The microprocessor 50 produces, in response to each one of the output pulses, SPDURs, a digital signal representative of the spark time duration of a corresponding one of the sparks produced across the electrodes 38, 40 of the corresponding one of the spark plugs 18. These digital signals are presented to a technician via a communication link 82 and scanning device 84. The technician compares the digital signals to determine whether the spark time duration of one of the spark plugs 18 is substantially different from the spark time durations of the other ones of the plurality of spark plugs 18.

More particularly, the flyback signal produced in the primary winding 22 is present at the collector electrode of the switching transistor 28 at each breakdown event. The voltage at the collector electrodes are fed to a spark time duration circuit 80, to be described in more detail in connection with FIG. 2. Suffice it to say here, however, that once the flyback signal is detected, it is conditioned by the spark time duration circuit 80 internal to the PCM 34 to produce a pulse having a time duration which directly correlates to the arc burn time or spark duration for a given spark event. This pulse is then sent to PCM's microprocessor 50 which timestamps and stores the value of the time duration in a register (REG2 and, if there is a re-strike, in REG4) to be described of the CPU 52. This is done for each consecutive spark event during each engine cycle. Once the registers (REGs) have accumulated a complete engine cycle (720°), the information is converted to a PID (parameter identification) with the appropriate time and units (mS) and sent via data link 82 to the scanning device 84.

In simplistic terms, a secondary ignition event consists of the breakdown voltage across the spark plug gap and the sustaining energy across the spark plug gap, arc burn time. Breakdown voltage, measured in kV, and arc burn time measured in mS, are inversely proportional.

As the secondary resistance increases, the breakdown kV required to cross the plug gap also increases while the sustaining arc burn time decreases. The higher the kV required to break down the spark plug gap, the less energy is left to sustain the arc burn across the gap. The inverse of this, low secondary resistance, results in lower required breakdown voltage and increased arc burn time.

Figure 3A:
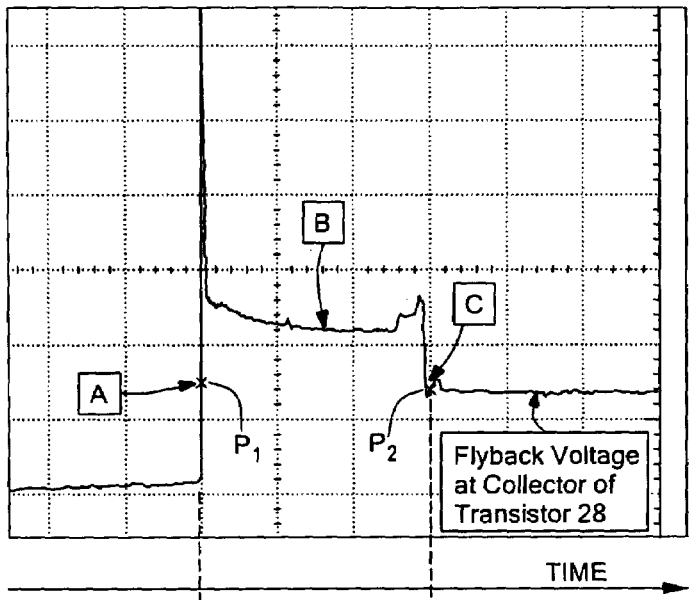
FIG. 3A is a timing history of a flyback voltage signal produced across the primary winding of an ignition coil used in the engine of FIG. 1.

Referring now to FIG. 3A, a typical flyback signal is shown. Spark duration is defined as the time measurement of an ignition coils; primary winding 22 flyback signal (i.e., voltage) between the rise of the initial breakdown voltage (A), through the sustaining voltage (duration of spark (B), to the falling edge of the sustaining voltage which ends at the battery voltage (C).

Figure 4:
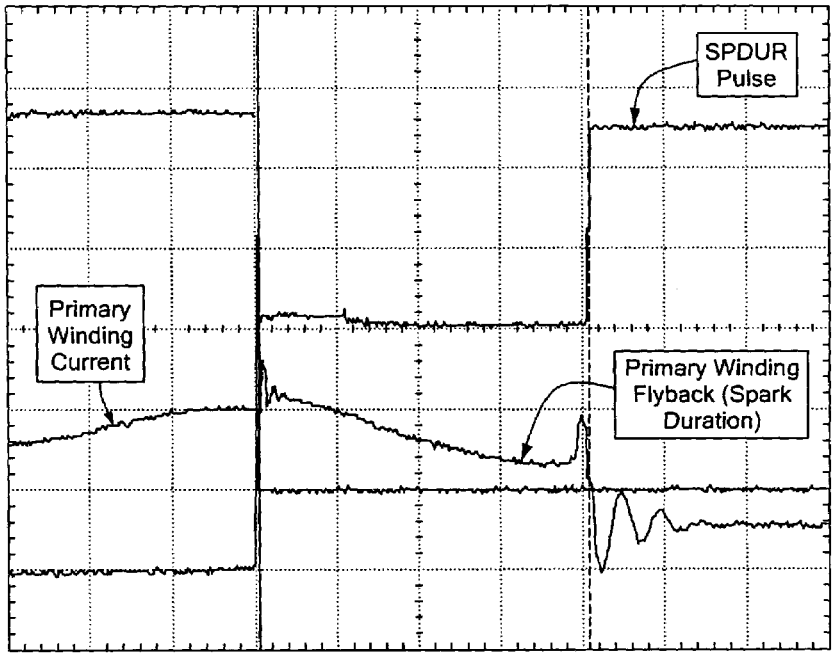
FIG. 4 are timing histories of a flyback voltage signal produced across the primary winding of an ignition coil, a primary winding current pulse, and the spark time duration pulse produced by the spark time duration circuit of FIG. 2 3A in the absence of any ignition system faults.
Figure 4A:
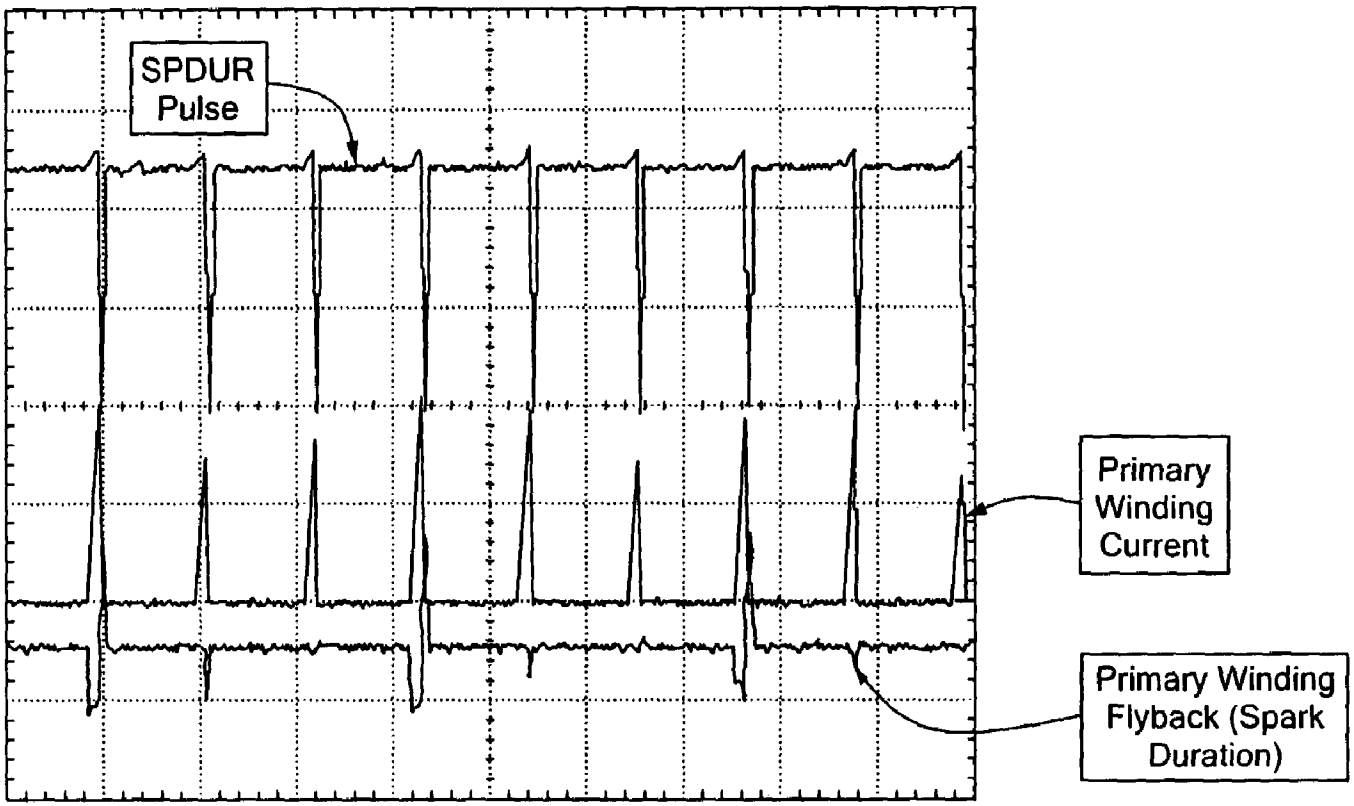

By measuring the arc burn time (i.e., the spark duration, FIG. 3A) determinations of secondary spark integrity is made. In a given engine cycle where no ignition fault is introduced in any cylinder, the measurement of the arc burn time relative to each cylinder remains consistent across all cylinder firings (during steady state load) as shown in FIGS. 4 and 4A. If high secondary winding 36 resistance (for example: an open secondary winding 36 or increased gap between the electrodes 38, 40) is present, the arc burn time (i.e., the spark duration, FIG. 3A) decreases relative to other cylinders as shown in FIG. 5, where the other no-fault cylinders have SPDUR pulses and flyback voltages which follow substantially the no-fault voltage time history across all the other seven cylinders indicated by the dotted lines 41 and 43, respectively, in FIG. 5.

Figure 5:
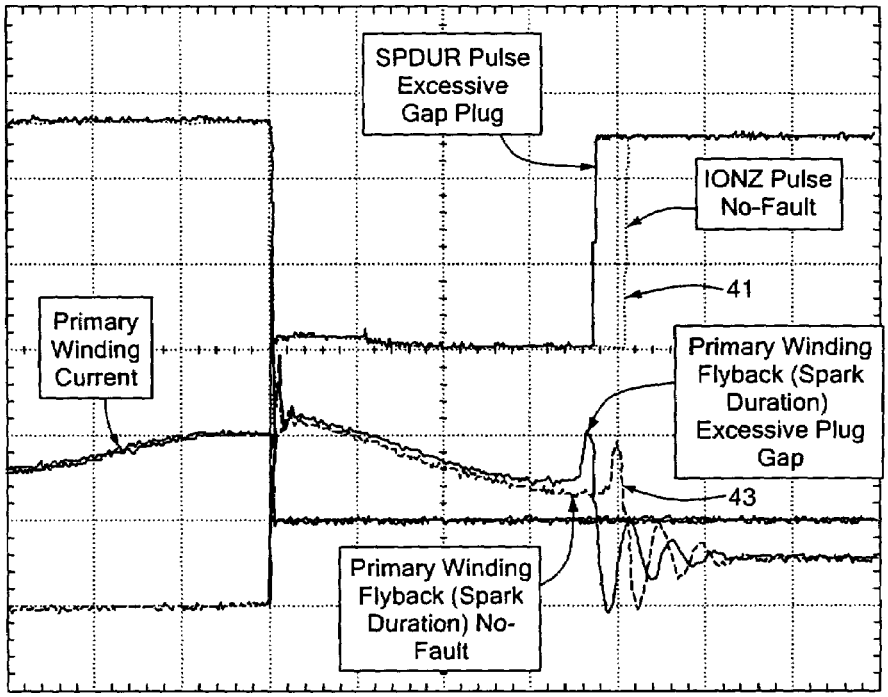
FIG. 5 are timing histories of a flyback voltage signal produced across the primary winding of an ignition coil, a primary winding current pulse, and the spark time duration pulse produced by the spark time duration circuit of FIG. 2 in the presence of an excessive spark plug gasp in the electrodes thereof and the spark time duration pulse produced by the spark time duration circuit of FIG. 2 in the absence of any ignition system faults.
Figure 6:
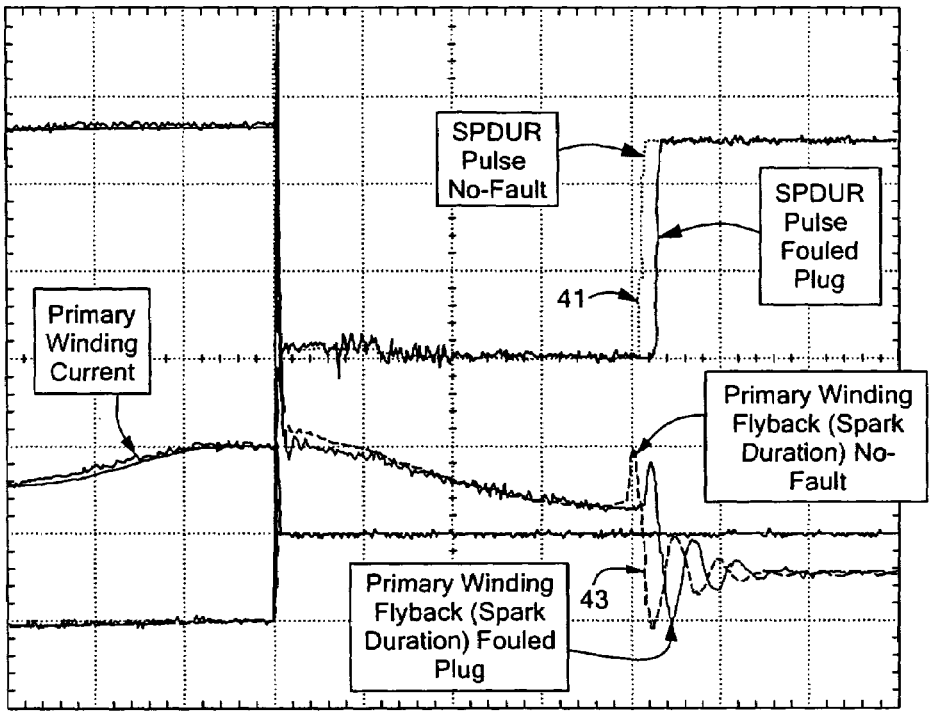
FIG. 6 are timing histories of a flyback voltage signal produced across the primary winding of an ignition coil, a primary winding current pulse, and the spark time duration pulse produced by the spark time duration circuit of FIG. 2 in the presence of a fouled spark plug and the spark time duration pulse produced by the spark time duration circuit of FIG. 2 in the absence of any ignition system faults.

If low secondary winding 36 resistance (for example: fuel fouled spark plug gap between the electrodes 38, 40) is present, the arc burn time (i.e., the spark duration, FIG. 3A) increases relative to the other cylinders, as shown in FIG. 6, where the other no-fault cylinders have SPDUR pulses and flyback voltages which follow substantially the no-fault voltage time history across all the other seven cylinders indicated by the dotted lines 41 and 43, respectively, in FIG. 5.

Figure 2:
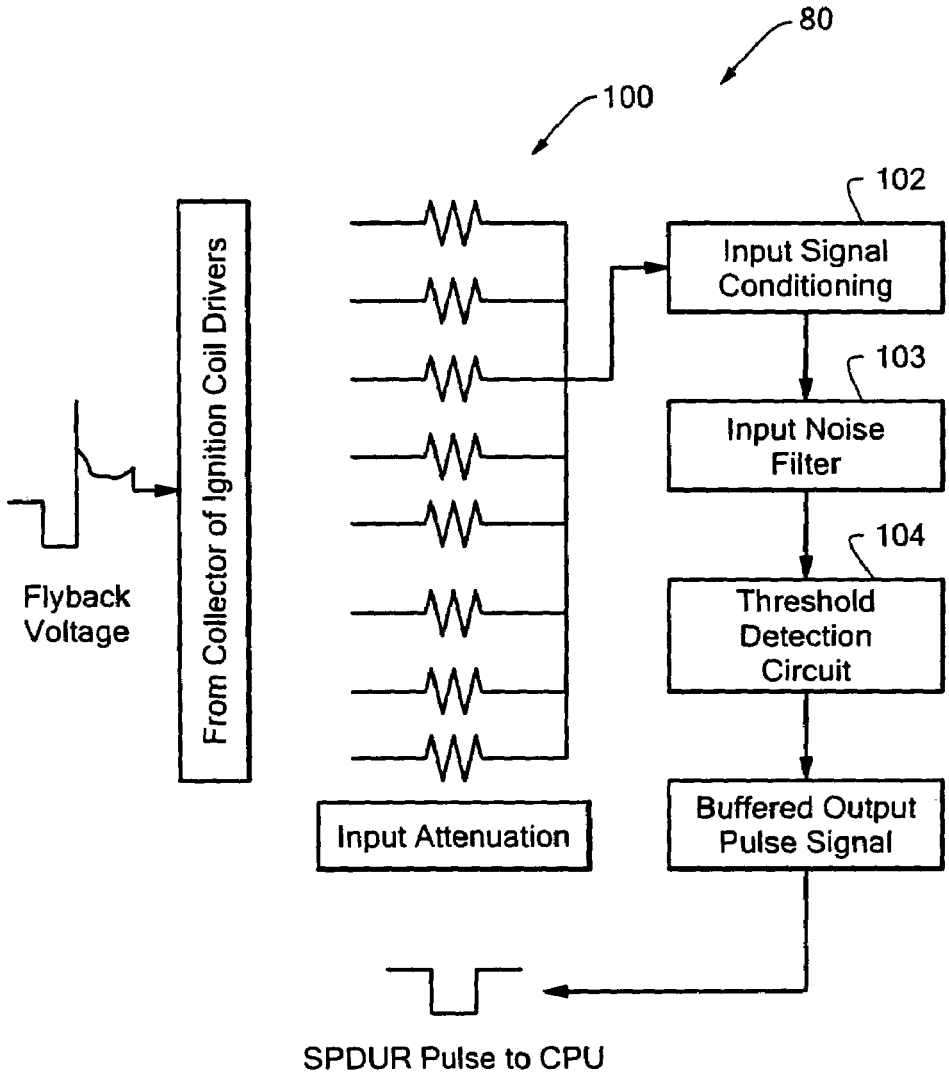
FIG. 2 is a schematic diagram of a spark time duration circuit used in the spark plug diagnostic system of FIG. 1 according to the invention.
Figure 3B:
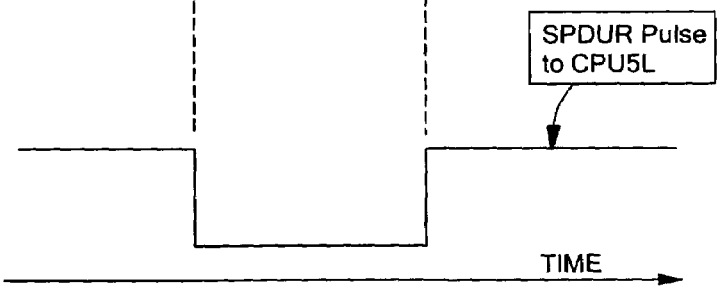
FIG. 3B is a timing history of a spark time duration pulse produced by the spark time duration circuit of FIG. 2 in response to the flyback voltage signal of FIG. 3A in the absence of any ignition system faults.

Referring now to FIG. 2, the spark time duration circuit 80 is shown to include a resistor- circuit 100 wherein each resistor is connected to the collector electrode of a corresponding one of the transistors 28, FIG. 1. Thus, the flyback voltages are sequentially coupled to a signal conditioning circuit 102, then to a noise filter 103 and then to a threshold, or comparator, circuit 104. The output of the threshold circuit 104 produces an SPDUR pulse (FIG. 3B), such SPDUR pulse having a time duration corresponding to the spark duration, FIG. 3A.

More particularly, when the flyback voltage produced at the collector electrode of one of the transistors 28 rises from a low value to a high value, during such transition, when the flyback voltage exceeds a predetermined voltage level, $P_1$, FIG. 3A, the SPDUR pulse produced at the output of the threshold circuit 104 is initiated (FIG. 3B) and goes to a low level and then subsequently, when the flyback voltage falls below a second predetermined voltage level $P_2$ (FIG. 3A) the SPDUR pulse (FIG. 3B) terminates and goes to a high level. The SPDUR pulse (FIG. 3B) is fed to the CPU 52 (FIG. 1)

Overview of Software Algorithm

Every time a spark plug fires, four pieces of data are captured into four discrete hardware registers (REG1, REG2, REG3 and REG4, FIG. 1) in the CPU 52 by the firmware in ROM 56. These four pieces of data are (1) the starting angle of the primary spark (REG1), (2) the duration of the primary spark (REG2), (3) the starting angle of the last re-spark (REG3), and (4) the duration of the last re-spark (REG4). The third and fourth pieces of data (REG3 and REG2) are only populated and relevant if the engine strategy is in Repetitive Spark mode, wherein the spark plug is fired multiple times in rapid succession for a single cylinder event. These hardware registers (REG1, REG2, REG3 and REG4) are overwritten by the firmware on every spark plug firing event, so it is up to the software to capture each cylinder's data as it appears in the registers (REG1, REG2, REG3 and REG4).

After each cylinder's firing event, the Spark High Level Driver requests the spark duration value and, in the case of the first cylinder in the firing order, the angle of the start of the spark event. Once received, the spark duration for that cylinder is stored in a PID array by cylinder number. Also, for the first cylinder in the firing order, the starting angle of the spark event is stored in a PID parameter. These PIDs are available at the vehicle's data link connector at any time. The "starting angle" PID will contain the data from the latest cylinder one firing event, and the "spark duration" PID array will contain the latest cylinder firing data from the cylinders, in round-robin fashion.

When the Low Level Driver receives a request for data from the High Level Driver, it first captures the data values from all four hardware registers (REG1, REG2, REG3 and REG4). Next, the data value from the hardware register representing (REG1) the starting angle of the primary spark is converted into Degrees relative to Top Dead Center (TDC). The two hardware registers (REG2, REG4) of CPU 52 representing spark durations are added and converted into Microseconds. Finally, the Low Level Driver returns the primary spark starting angle and the combined spark durations to the High Level Driver.

Software Algorithm

Figure 7:
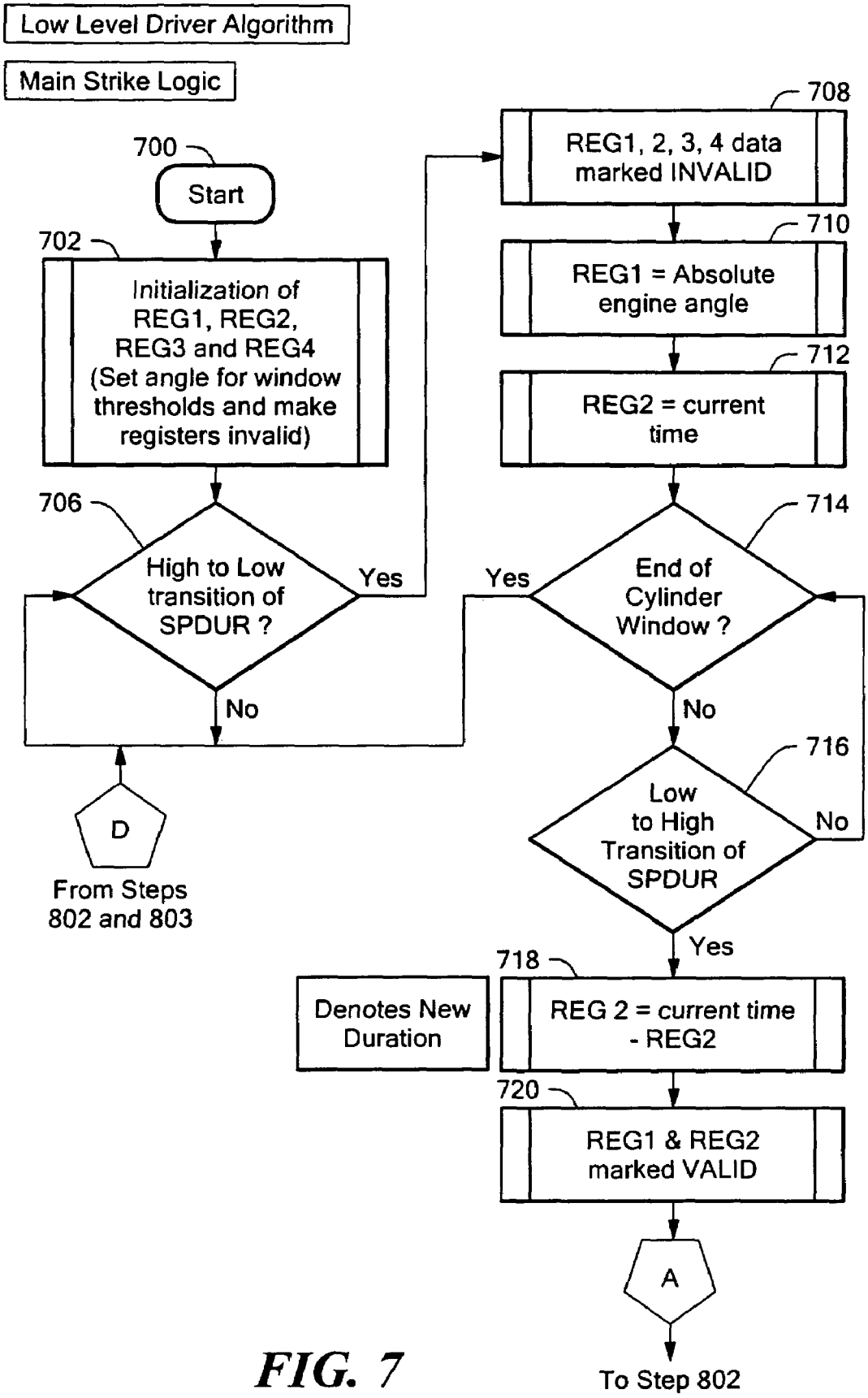
FIG. 7 is a flow diagram of a low level driver program used in the system of FIG. 1 to determine a main spark or strike.

Referring now to FIG. 7, and considering one of the here eight cylinders, the main strike logic portion of the low level driver algorithm is shown. The process stored in ROM 50, starts in Step 700 and the CPU 52 (FIG. 1) sets the angle for the first cylinder window threshold and initializes the four registers REG1, REG2, REG3 and REG4 to an invalid data state, Step 702.

When nothing is happening in the engine, the SPDUR pulse is at a "high" voltage. That is, the normal condition i.e., in the absence of a spark pulse applied to the primary winding 22 (FIG. 1) the output of the second comparator circuit 106 (FIG. 2), i.e., the ionization (SPDUR) voltage is "high".

When the SPDUR voltage goes from (i.e., transitions) a "high" level to a "low" level, thereby indicating the start of the arc burn time in Step 706, (i.e., the start of the spark duration, FIG. 3B, measurement), the CPU 52 marks, or flags all four registers (REG1, REG2, REG3 and REG4) as invalid (Step 708), stores the absolute crankshaft angle relative to Top Dead Center (TDC) from sensor 48 (FIG. 1) into REG1 (Step 710) at the time the spark pulse commences (i.e., at the time of the start of the burn), and stores the current microprocessor 50 (not shown) clock time and stores it into REG2. The four registers (REG1, REG2, REG3 and REG4) are marked invalid so that if the high level driver, to be described in connection with FIG. 9, which is operating asynchronously with the low level driver, requests data for this cylinder in any of the four registers (REG1, REG2, REG3 and REG4), the high level driver will know that such data are, at this time, invalid, since there is not a complete set of data for this cylinder yet.

In Step 714 the CPU determines whether the data accumulation window is completed. That is, whether the current crankshaft angle has rotated 720 degree divided by the number of cylinders. Thus, in this 8-cylinder example, the CPU determines whether the engine has rotated 90 degrees.

If the crankshaft angle has not rotated in this example 90 degrees, the CPU waits for a "low" to "high" transition of the SPDUR voltage, Step 716. When there is such "low" to "high" transition of the SPDUR voltage a pulse, thereby indicating the end of the spark duration, FIG. 3B, the CPU subtracts the time stored in REG2 from the current microprocessor 50 clock time and stores the time difference back into REG2, Step 718. The contents in REG2 now represents the spark time duration of the first spark event for the particular one of the cylinders being monitored and is referred to as a time stamp. The registers REG1 and REG2 are marked as "valid" for use by the high level driver which operates the scanning device 84 (FIG. 1) via data link 82 to the PCM 34, Step 720 and the process proceed to Step 802 of the re-strike logic portion of the low level driver, FIG. 8. It should be noted that if, in Step 714 the current cylinder window has ended, the process returns to Step 706.

Figure 8:
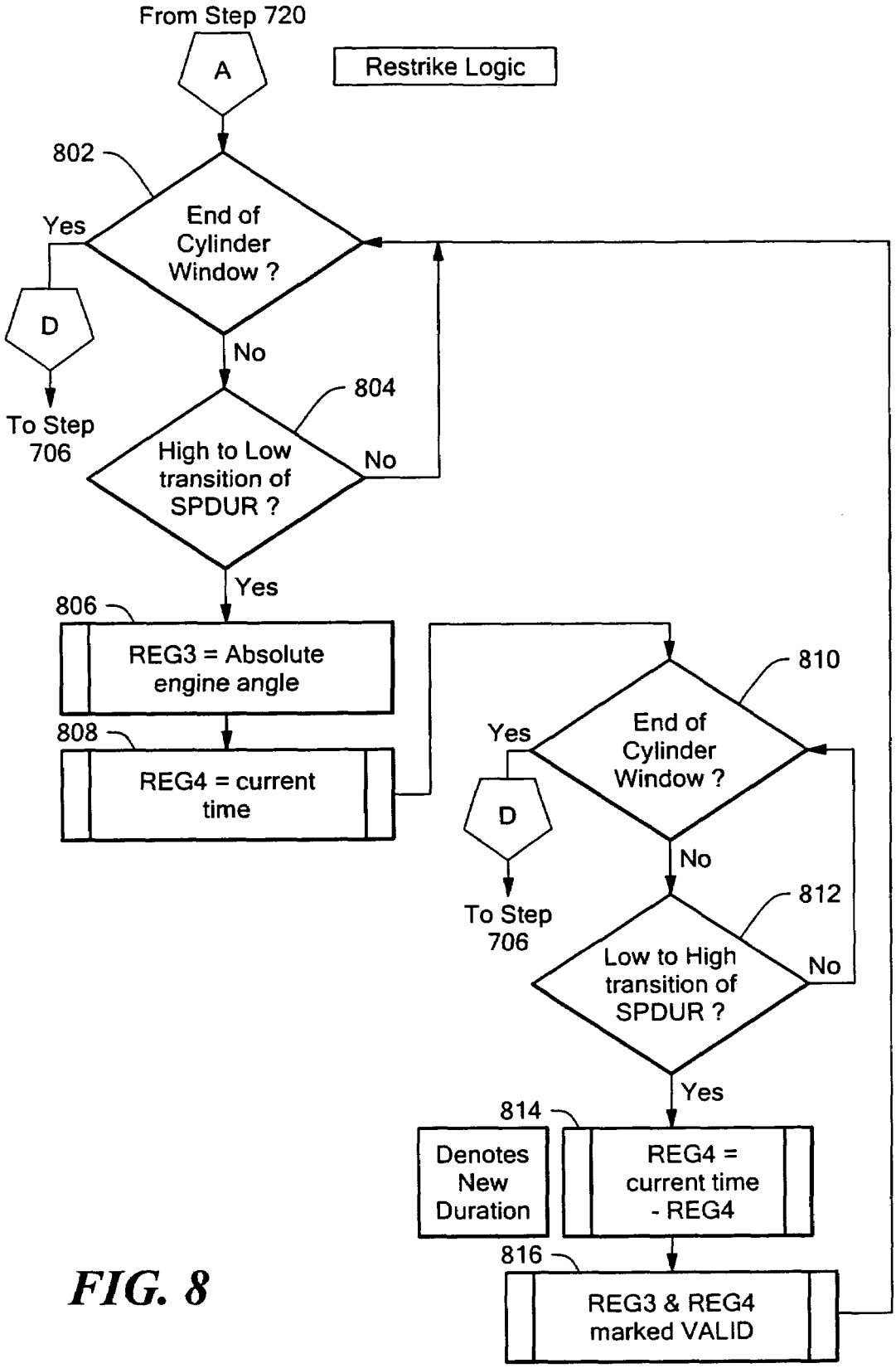
FIG. 8 is a flow diagram of the low level driver program used in the system of FIG. 1 to determine a re-strike.

Referring now to FIG. 8, when the re-strike operation is enabled, i.e., when the same spark plug in the cylinder is to be fired for the same combustion event, (i.e., cylinder window). Thus, when there are "m" sparkings for the same cylinder event, "m−1" timestamp updates will be applied to REG4.

Thus, in Step 802, the CPU determines for the same cylinder being monitored, whether the cylinder window has ended. If the window has ended, the process returns to Step 706, FIG. 7). On the other hand, if the window has not ended, the CPU waits for the transition, the CPU knows that a re-strike is occurring.

If there is a high to low transition, the CPU stores the absolute crankshaft shaft angle relative to Top Dead Center (TDC) from sensor 48 (FIG. 1) into REG3 (Step 806) at the time the spark pulse commences (i.e., at the time of the start of the burn), Step 806, and stores the current microprocessor 50 clock time and stores it into REG4, Step 808

The CPU 52 continues to determine, for the same cylinder being monitored, whether the cylinder window has ended, Step 810. If the window has ended, the process returns to Step 706 (FIG. 7). On the other hand, if the window has not ended, the CPU 52 waits for the SPDUR pulse to experience a low to high transition, Step 812. If there is a low to high transition, the CPU 52 knows that the end of the spark duration, FIG. 3B, has occurred and the CPU subtracts the time stored in REG4 from the current microprocessor 50 clock time and stores the time difference into REG4, Step 814. The contents in REG4 now represents the spark time duration, or time stamp, of the re-strike. The registers REG3 and REG4 are marked as "valid" for use by the high level driver that operates the scanning device 84 (FIG. 1) via data link 82 to the PCM 34, Step 816 and the process returns to Step 802 to determine whether there is a subsequent re-strike. It is noted that REG3 and REG4 are overwritten with data from the latest re-strike for the given cylinder, n, being examined.

It is noted that if there is no re-strike, the process goes from Step 802 to Step 706 for the next cylinder, n, being examined. It is also noted that REG2 stores the time stamp (i.e., time duration) of the main strike and REG4 stores the time stamp (i.e., time duration) of the latest re-strike.

Figure 9:
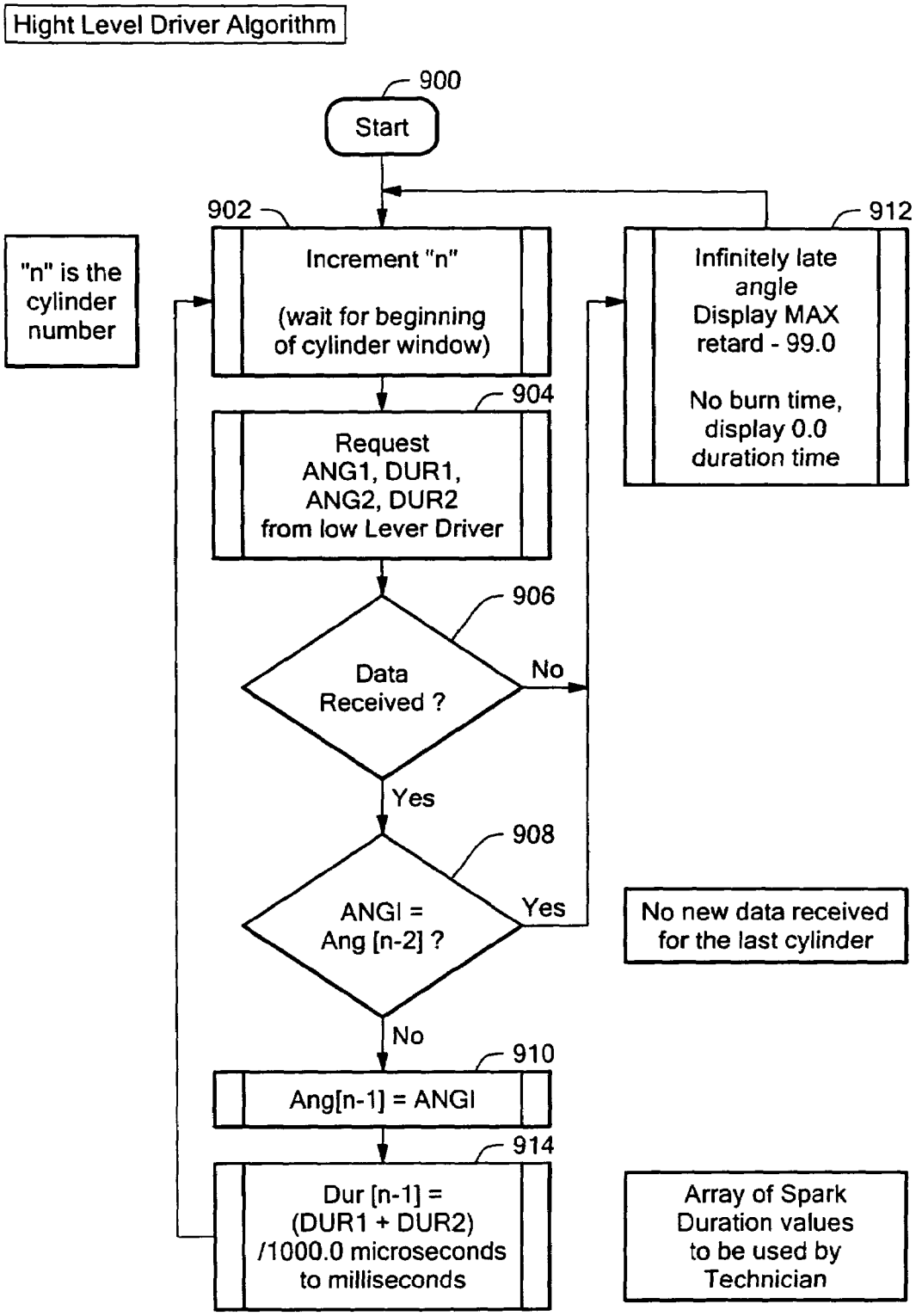
FIG. 9 is a flow diagram of a high level driver program used in the system of FIG. 1 to present data to a scanning device used in the system of FIG. 1 for use by a technician.

Referring now to FIG. 9, the high level driver process starts in Step 900. In Step 902, every "720/number-of-cylinders" degrees, a cylinder increment is performed by the firmware indicating the beginning of a new cylinder window.

Thus, in Step 904, the high level driver requests the data stored in REG1, REG2 REG3 and REG4 from the low level driver. The data in REG1 is referred to as ANG1, the data in REG2 is referred to as DUR1, the data in REG3 is referred to as ANG2, and the data in REG4 is referred to as DUR2. In Step 906, if the data request from the low level driver was invalid, the process proceeds to Step 912, which produces data values indicating that no burn was detected for the previous cylinder event.

When the data ANG1, DUR1, ANG2, and DUR2 are received, in Step 908 the high level driver determines whether the crankshaft angle ANG1 (i.e., the crankshaft angle at the beginning of the main strike) is the same as the crankshaft angle from two cylinders ago (n−2), such would indicate that the spark plug or ignition coil 20 from the just processed cylinder (n−1) was dead. That is, data are not updated in REG1 through REG4 unless there is a firing, i.e., an SPDUR pulse. Thus, if the REG1 has the same crankshaft angle data the CPU knows that there has been no firing in the prior cylinder window. The process, in the event that there was not a cylinder firing, proceeds to Step 912. In Step 912, the CPU produces an indication to the scanning device 84 (FIG. 1) that there has been no burn time for the cylinder n−1 in the PID array in RAM 58 (FIG. 1).

On the other hand, if in Step 908 there was a burn event, the process proceeds to Step 910. In Step 910, the CPU takes the angle in REG1 and stores such data for the last cylinder n−1 in the PID array of RAM 58 Next, in Step 914, the CPU determines the time duration to be passed to the scanning device 84 (FIG. 1) for the service technician for the last cylinder, n−1. The displayed time duration is the sum of the contents in REG2 and REG4 (i.e., DUR1+DUR2)/1000 yielding milliseconds, since the contents of REG2 and REG4 are in microseconds).

Figure 10:
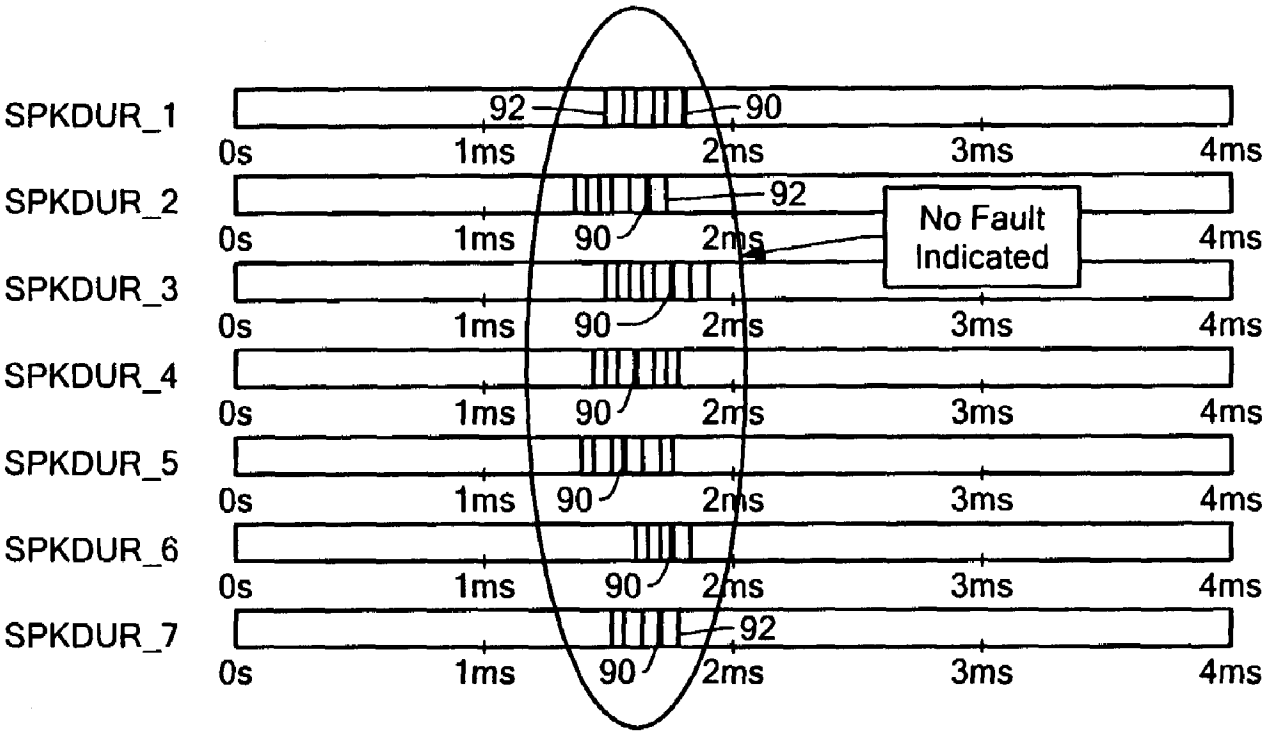
FIGS. 10, 11 and 12 are typical histograms produced by the process of FIGS. 7. 8 and 9, for display on the scanning device for observation by the technician.
Figure 11:
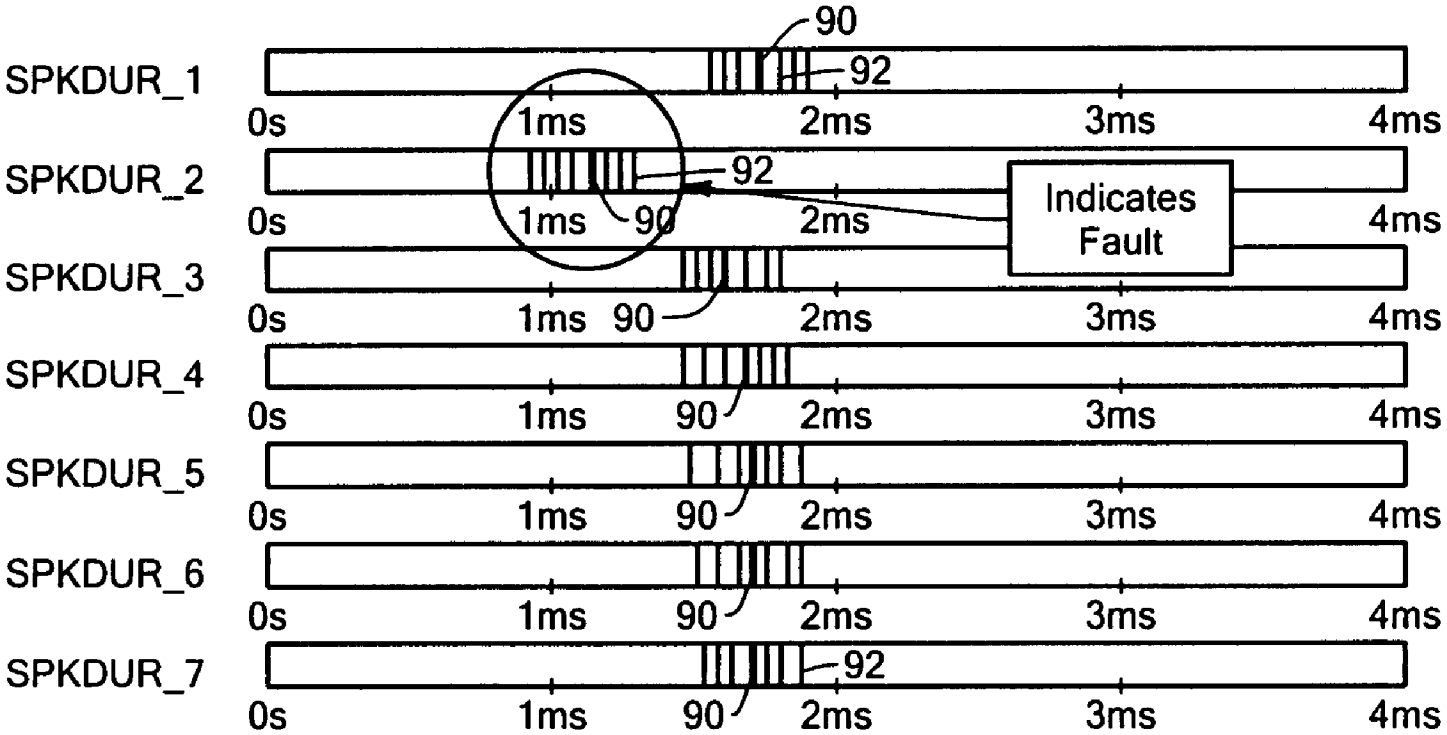
Figure 12:
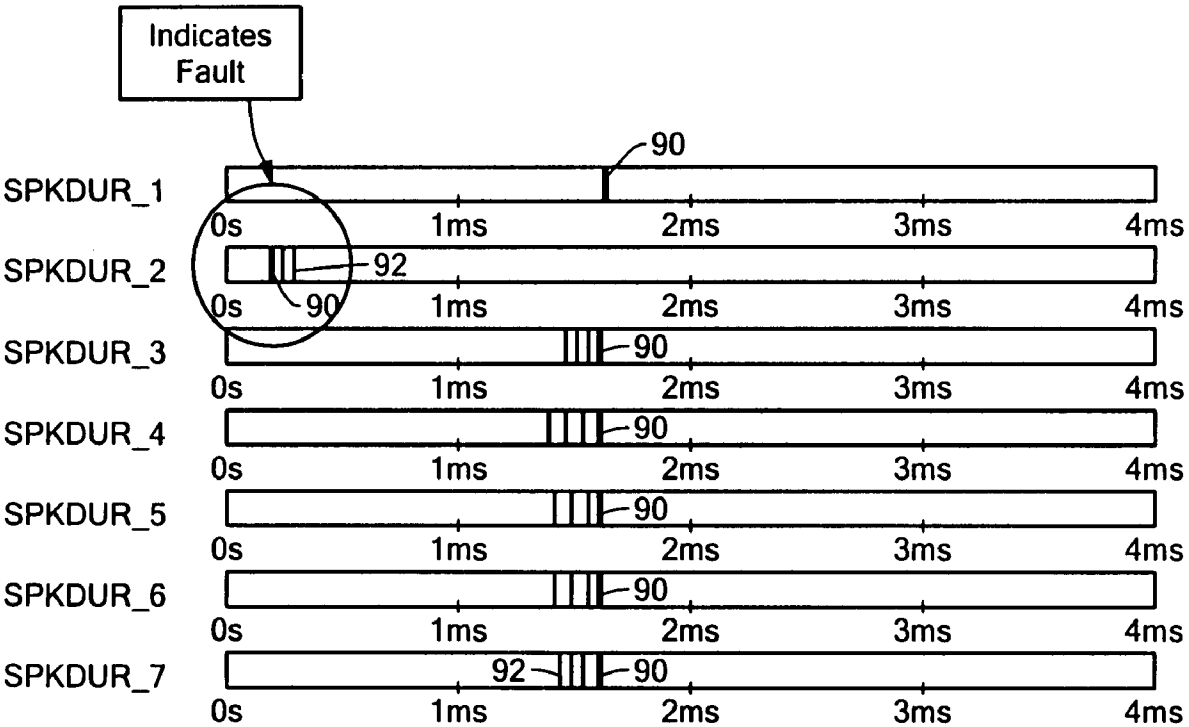

Typical histograms produced by the process described above in FIGS. 7, 8 and 9 for the eight cylinders are shown in FIGS. 10, 11 and 12, only seven cylinder spark time durations (SPKDUR_1 through SPKDUR_7 being shown). These histograms are displayed on the scanning device 84 for observation by the technician. It is noted that for each cylinder there is a dark line 90 indicating the current time stamp for the cylinder and lighter lines indicating previous, time stamps, i.e., lines 92. Thus, referring to FIG. 10 the current time stamps, line 90, for all eight cylinders are substantially the same (i.e., substantially aligned) therefore indicating proper sparking. It s noted, however, that there was a misfire for cylinder 2 because one prior time stamp, 92*a,* of such cylinder did not align substantially with the time stamps of the other cylinders.

Referring to FIG. 11, a fault in cylinder 2 is indicated because the current timestamp 90, as well as prior time stamps 92 for such cylinder, is substantially different from the timestamps of the other seven cylinders. The condition indicates that there is secondary arcing to the plug well.

FIG. 12 indicates a fault in cylinder 2 because of the short duration of the spark an open condition is indicated in the secondary winding.

Thus, we have discovered that by monitoring the ignition coil primary winding 22 flyback signals internal to the PCM 34 (FIG. 1), it is possible to diagnose multiple secondary issues, as well as primary. By measuring the ignition coil 20 primary winding 22 flyback spark duration, or burn time, decisions can be made as to the quality of the spark event. For example, a short duration indicates high resistance in the secondary while long durations show a short or foul condition. Onboard (i.e., in the PCM 34) spark duration analysis provides a non-intrusive method of monitoring and analyzing secondary spark duration as well as providing a method to measure inaccessible coils which would aid in diagnosing root cause failures as well as reduce warranty costs.

The value of each cylinder's spark duration pulse width is displayed to the technician in a PID format via the communication link. A "block" of relative time duration values, for, in this example all 8 cylinders, is displayed (2 continuous revolution displaying 1 complete engine cycle) as described above in connection with FIGS. 10, 11, and 12. Data are stored in the PID array of RAM 58 and displayed to the technician for one complete engine cycle. The data displayed to the technician are for a complete engine cycle (2 revolutions). No determination of "Pass" vs. "Fail" would be able to be made by the PCM 34, (these judgments would be made by the technician based on his interpretation of the relative duration readings), nor would any DTC be set based on duration values. Thus, the OBD Spark Duration test may be used in addition to the present misfire DTC's as well as ignition coil primary winding charge current DTC's.

The invention thereby provides a totally non-intrusive means of identifying secondary ignition failures in an inductive ignition system. The method requires no external engine connections by the technician to interrogate all engine cylinder secondary ignition spark events. Measurement of the ignition coil 20 primary winding 22 flyback signal as well as data transfer is done entirely internal to the Powertrain Control Module (PCM). Each cylinder's spark event is compared to the other cylinder's spark event (relative reading) for each complete engine cycle (720°) via a scan tool connected at the data link connector. This allows the technician to investigate the ignition system secondary, regardless of ignition coil 20 accessibility, simply by connecting a scan tool to the vehicle data link connector 82.

A number of embodiments of the invention have been described. For example, a vehicles ignition system according to the invention may contain an ignition coil for each cylinder, as is the case with COP (coil on plug), firing one spark plug per secondary event, or may utilize a coil for each pair of cylinders, firing 2 spark plugs per coil secondary event, as in the case of the distributorless ignition system (DIS). Monitoring the secondary ignition flyback signal at the coil power output driver and measuring the flyback signals arc burn time or spark duration can aid in the identification of multiple ignition failures.

Nevertheless, it will be understood that various modifications may be made without departing from the spirit and scope of the invention. Accordingly, other embodiments are within the scope of the following claims.

What is claimed is:

1. A method for diagnosing ignition system performance of an internal combustion engine having a plurality of spark plugs; a plurality of ignition coils, each one having a secondary winding coupled to a corresponding one of the plurality of spark plugs, each one of the plurality of ignition coils having a primary winding; and an engine control unit, such method comprising:

operating the engine control unit to produce a sequence of spark ignition current pulses through the primary winding of the plurality of ignition coils, such current pulses producing voltage pulses across electrodes of the spark plugs, such voltage pulses producing sparks across the electrodes of the spark plugs and flyback voltages across the primary windings;

producing, in response to the flyback voltages, digital signals representative of the time durations of the sparks; and comparing the digital signals to determine whether the spark time duration of one of the spark plugs is substantially different from the spark time durations of the other ones of the plurality of spark plugs.

2. The method recited in claim 1 wherein the time duration is the time between the rise of the initial breakdown voltage, through the sustaining voltage, to the falling edge of the sustaining voltage.

3. A method for diagnosing ignition system performance of an internal combustion engine having a plurality of spark plugs; a plurality of ignition coils, each one having a secondary winding coupled to a corresponding one of the plurality of spark plugs, each one of the plurality of ignition coils having a primary winding; and an engine control unit, such method comprising:

operating the engine control unit to produce a sequence of spark ignition current pulses through the primary winding of the plurality of ignition coils, such current pulses producing voltage pulses across electrodes of the spark plugs, such voltage pulses producing sparks across the electrodes of the spark plugs and flyback voltages across the primary windings;

producing, in response to the flyback voltages, output pulses having time durations related to the time durations of the sparks produced across the electrodes of the spark plugs;

producing, in response to each one of the output pulses, a digital signal representative of the spark time duration of a corresponding one of the sparks produced across the electrodes of the corresponding one of the spark plugs; and comparing the digital signals to determine whether the spark time duration of one of the spark plugs is substantially different from the spark time durations of the other ones of the plurality of spark plugs.

4. The method recited in claim 3 wherein the time duration is the time between the rise of the initial breakdown voltage, through the sustaining voltage, to the falling edge of the sustaining voltage.

* * * * *